US005502981A

United States Patent [19]

Sullivan

[11] Patent Number: 5,502,981

[45] Date of Patent: Apr. 2, 1996

[54] INSERT ASSEMBLY FOR CHANGING TEMPERATURE OF QUANTITY OF LIQUID CONTAINED IN BOTTLE

[76] Inventor: Kimberly M. Sullivan, 4350 La Jolla Village Dr., Ste. 300, San Diego, Calif. 92122

[21] Appl. No.: 406,365

[22] Filed: Mar. 17, 1995

[51] Int. Cl.[6] ..... F25D 3/08

[52] U.S. Cl. ..... 62/372; 62/457.4; 220/522

[58] Field of Search ..... 62/371, 372, 400, 62/457.1, 457.2, 457.3, 457.4, 529, 530; 220/522

[56] References Cited

U.S. PATENT DOCUMENTS

| | | | |
|---|---|---|---|
| 1,030,325 | 6/1912 | Yelton | 62/457.1 |
| 1,954,369 | 4/1934 | Solomon | 62/457.4 |
| 2,288,044 | 6/1942 | Stemme | 62/457.4 |
| 2,526,165 | 10/1950 | Smith | 62/457.4 |
| 3,840,153 | 10/1974 | Devlin | 222/146 C |
| 4,531,383 | 7/1985 | Zimmermann | 62/457.4 |
| 5,009,083 | 4/1991 | Spinos et al. | 62/400 |
| 5,129,238 | 7/1992 | Schwartz et al. | 62/457.3 |
| 5,189,892 | 3/1993 | Roberts | 62/457.3 |

FOREIGN PATENT DOCUMENTS

| | | | |
|---|---|---|---|
| 2291683 | 6/1976 | France | 215/11.2 |
| 2652061 | 5/1978 | Germany . | |
| 3836424 | 7/1989 | Germany . | |

*Primary Examiner*—John M. Sollecito
*Attorney, Agent, or Firm*—John R. Flanagan

[57] ABSTRACT

An insert assembly for use in changing the temperature of a quantity of liquid contained in a bottle includes an end cap securable to the bottle, an elongated hollow insert member connected to the end cap and filled with a material provided at a temperature different from the quantity of liquid and adapted to extend downward from the end cap and into the quantity of liquid when the end cap is secured on the bottle, and a removable protective cover which encloses at least the insert member when the end cap is removed from the bottle to protect it from contamination. In one embodiment, the protective cover is an elongated protective sleeve removably fittable over the insert member and onto the end cap when the end cap is removed from the bottle so as to enclosed the insert member. In another embodiment, the protective cover includes a carton having a body open at one end and a lid for opening and closing the open end of the carton body. The protective cover also includes a pair of web members spaced from one another and attached to and extending between a pair of opposite sides of the carton and having apertures defined therein for receiving the insert member and thereby supporting the insert member within the carton.

21 Claims, 2 Drawing Sheets

10
12
14
16
18
20
20A
22
24
24A
26
28
30
32
32A
32B
34
36
38
40
42
42A
42B
44
46
48
50
B
S
T
L

INSERT ASSEMBLY FOR CHANGING TEMPERATURE OF QUANTITY OF LIQUID CONTAINED IN BOTTLE

BACKGROUND OF THE INVENTION

1. Field of the Invention

The present invention generally relates to bottles used to contain liquids and, more particularly, is concerned with an insert assembly for changing the temperature of a quantity of liquid contained in a bottle.

2. Description of the Prior Art

Young children are often fed formula dispensed from a bottle. Generally, a parent heats the formula before feeding it to their child. However, sometimes the formula is heated too much. This overheated formula must be cooled before the child drinks it. To cool overheated formula, parents often resort to inefficient, time-consuming and frustrating measures such as placing the formula bottle in cool water. While this method works, a more efficient method which employs a reusable cooling device is available.

Several devices exist for cooling liquids which include hollow inserts or the like filled with frozen or cooled material. The hollow inserts extend downward from caps or covers placed on the liquid container into the liquid to be cooled. Examples of such devices are disclosed in U.S. Pat. No. 1,954,369 to Solomon, U.S. Pat. No. 4,531,383 to Zimmermann and U.S. Pat. No. 5,129,238 to Schwartz. Heat is transferred from the warmer liquid to the frozen insert thereby warming the insert and cooling the liquid. As with the device disclosed in U.S. Pat. No. 5,129,238 to Schwartz, some inserts can be removed from the liquid and placed in a freezer to freeze the material in the insert. The insert can then be used again to cool additional liquids. Such reusable devices represent an efficient and effective means for cooling liquids, including formula. However, a major drawback of prior art devices is that the inserts can become contaminated when placed in a freezer. While a contaminated insert can be rinsed in warm water to clean it, doing so prematurely begins melting of the frozen material in the insert thereby reducing its effectiveness.

Consequently, a need still exists for a device to cool liquids, such as formula, in a manner that is both effective and sanitary.

SUMMARY OF THE INVENTION

The present invention provides an insert assembly designed to satisfy the aforementioned need by avoiding the drawbacks of the prior art without introducing other drawbacks. The insert assembly of the present invention is adapted for use in selected changing, either by reducing or elevating, the temperature of a quantity of liquid contained in a bottle.

Basically, the insert assembly comprises: (a) an end cap removably securable on the top of a bottle; (b) an elongated hollow insert member connected to and supported by the end cap and extending therefrom so as to extend into a quantity of liquid in the bottle upon securing the end cap on the top of the bottle; and (c) an elongated protective cover for removably enclosing the insert member when the insert member is removed from the quantity of liquid in the bottle. The hollow insert is adapted to hold a material, such as water, at a desired temperature different from that of the quantity of liquid in the bottle for causing the desired change in the temperature of the liquid. The insert assembly also comprises an ornamental body connected to and seated upon the end cap.

There are two embodiments of the protective cover of the insert assembly. In a first embodiment, the protective cover is an elongated protective sleeve removably fittable over the insert member and onto the end cap when the end cap is removed from the bottle. The cover together with the end cap encloses the insert member. The cover attaches onto the end cap such that the end cap cannot be secured on the top of the bottle while the cover is attached to the end cap. In a second embodiment, the protective cover includes a carton having a body open at one end and a lid for opening and closing the open end of the carton body. The protective cover also includes means in the form of a pair of web members spaced from one another and attached to and extending between a pair of opposite sides of the carton and having apertures defined therein for receiving the insert member and thereby supporting the insert member within the carton.

One feature of the present invention is that the insert assembly is reusable. When not in use and in the situation where the insert member of the assembly is used to cool liquid, the assembly with the insert member enclosed by the protective cover is stored in a freezer to keep the material in the insert member frozen. To use the insert assembly, it is removed from the freezer, the end cap and insert member are removed from the protective cover, and the end cap is secured on the top of a bottle that contains the liquid to be cooled such that the insert member extends into the liquid. Due to the temperature differential existing between the insert member and material therein and the adjacent liquid, heat is transferred from the center of the quantity of liquid in the bottle through the insert member to the frozen material substantially melting the frozen material and cooling the liquid in the bottle. After the liquid is cooled, the end cap with the insert member are removed from the bottle and cleaned. Then, at least the insert member is enclosed by the protective cover to reassembly the insert assembly, and the insert assembly is replaced in the freezer where the material in the insert member is frozen again thereby readying it for another use.

Another feature of the present invention, which will be readily understood from the above-described method of use of the insert assembly, is that the removable protective cover protects the insert member from contamination when the insert assembly is not secured on a bottle. After the insert assembly is used, the insert member can be cleaned and then the protective cover is placed over the insert member before the insert assembly is replaced in the freezer. The cover is not removed until immediately before securing the end cap of the assembly on another bottle.

An additional feature of the present invention is that more than one insert assembly can easily be employed in succession to cool a very warm quantity of liquid (or, in the opposite situation, to heat a very cold quantity of liquid). If the liquid in the bottle is very warm, the material in the insert member may completely melt before the liquid has been cooled to the desired temperature. If this happens, the insert assembly can easily be removed from the bottle and another insert assembly can be taken out of the freezer and secured on the bottle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3, 4:
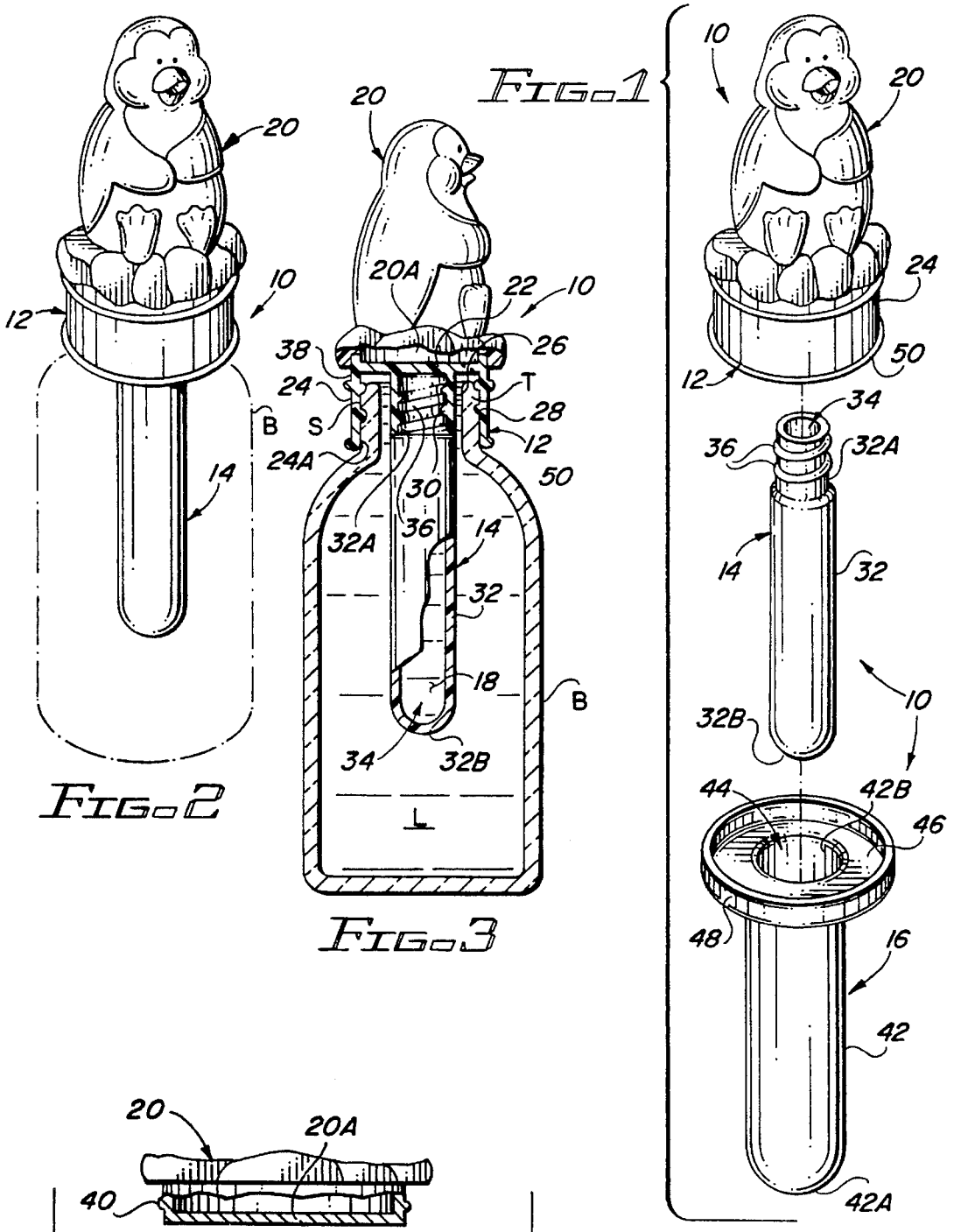
FIG. 1 is an exploded perspective view of first embodiment of an insert assembly of the present invention having a decorative end cap, a reusable insert member connectable to the end cap, and a protective cover for removably fitting over the insert member and onto the end cap when the insert member is not in use.
FIG. 2 is a perspective view of the insert assembly of FIG. 1 with the protective cover removed and the end cap secured on the mouth of a bottle shown in phantom outline form.
FIG. 3 is a longitudinal sectional view, with portions shown in elevation, of the insert assembly with the protective cover removed and the end cap applied on the top of the bottle containing a quantity of liquid.
FIG. 4 is an enlarged fragmentary longitudinal sectional view of a lower end portion of a decorative body aligned with an upper end portion of the end cap of the insert assembly.

Referring now to the drawings and particularly to FIG. 1, there is illustrated a first embodiment of an insert assembly of the present invention, generally designated 10, for use in conjunction with a bottle B to change the temperature of a quantity of liquid L contained in the bottle B. The insert assembly 10 of the present invention will be described hereinafter being applied to a baby bottle B containing a quantity of overheated formula L. In such application, the insert assembly 10 is employed to reduce the temperature thereof or, in other words, to cool the formula L to a point where a small child can safely drink it from the bottle B. However, the insert assembly 10 is equally applicable in the opposite situation where it is used to increase or elevate the temperature of a liquid L contained in a bottle B. Also, the term "bottle" and "quantity of liquid" are used herein in a generic sense to include a variety of different types of containers and fluid material.

Referring to FIGS. 1–5, the first embodiment of the insert assembly 10 basically includes an end cap 12 removably securable on the top T of the bottle B, an elongated hollow insert member 14 connected to and supported by the end cap 12 and extending therefrom so as to extend into the quantity of liquid L contained in the bottle B upon securing the end cap 12 onto the top T of the bottle B, and an elongated protective cover 16 in the form of a sleeve removably fittable over the insert member 14 and attachable onto the end cap 12 when the end cap 12 is removed from the bottle B and the insert member 14 is removed from the quantity of liquid L therein such that the cover 16 together with end cap 12 enclose the insert member 14. The protective cover 16 attaches onto the end cap 12 in a manner such that the end cap 12 cannot be secured on the top T of the bottle B while the cover 16 remains attached to the end cap 12. Also, the hollow insert member 14 is adapted to hold a material 18, such as water, having a desired temperature different from that of the quantity of liquid L in the bottle B for causing the desired change in the temperature of the liquid L. The insert assembly 10 also includes an ornamental body 20, such as a figure depicting a penguin, connected to and seated upon the top of the end cap 12.

Referring to FIGS. 1–3, the end cap 12 of the insert assembly 10 includes a flat top wall 22, an outer annular, preferably cylindrical, sidewall 24 attached to the periphery of the top wall 22 and extending downwardly from the top wall 22, and an inner annular, preferably cylindrical, socket wall 26 attached to and extending downwardly from the top wall 22 and spaced inwardly from the outer annular sidewall 24. The end cap 12 also includes first means 28, preferably in the form of first screw threads, defined on an interior side of the outer annular sidewall 24. The first screw thread 28 on the outer annular sidewall 24 of the end cap 12 are releasably mateable with securing means S, typically in the form of complementary screw threads, defined on an exterior side of the top T of the bottle B. In such manner, the end cap 12 is removably secureed on the top T of the bottle B. The end cap 12 further includes second means 30, preferably in the form of second screw threads, defined on the interior side of the inner annular socket wall 26.

The insert member 14 of the assembly 10 includes an elongated tubular body 32 open at the top end 32A and closed at the bottom end 32B thereof and defining a compartment 34 extending therebetween being adapted to hold the material 18, such as water, therein. The material 18, either by respectively heating it or cooling it, is provided at a desired temperature different from that of the quantity of liquid L in the bottle B. The insert member 14 also includes fastening means 36, preferably in the form of third screw threads, defined on the exterior side of the upper end portion 14A of the insert member 14. The third screw threads 36 on the insert member 14 are releasably mateable with the second screw threads 30 on the inner annular socket wall 26 of the end cap 12 so as to secure the insert member 14 to and support it from the inner socket wall 26 of the end cap 12 in a sealed relationship preventing the water 18 therein from leaking.

Referring to FIGS. 1 and 2, and in particular to FIGS. 3 and 4, the ornamental body 20 is connected to and seated upon the end cap 12. The end cap 12 also has an upper annular wall 38 attached to and extending upwardly from the flat top wall 22 of the end cap 12. The ornamental body 20 has a lower portion 20A with an outer annular element in the form of a bead 40 adapted to frictional interfit with and inside of the upper annular wall 38 of the end cap 12. Also, an adhesive can be applied between the flat top wall 22 of the end cap 12 and the lower portion 20A of the ornamental body 20 to securely connect the ornamental body 20 thereon. Alternatively, the ornamental body 20 and end cap 12 can be fabricated to be integrally connected and have a one-piece construction.

Figure 5:
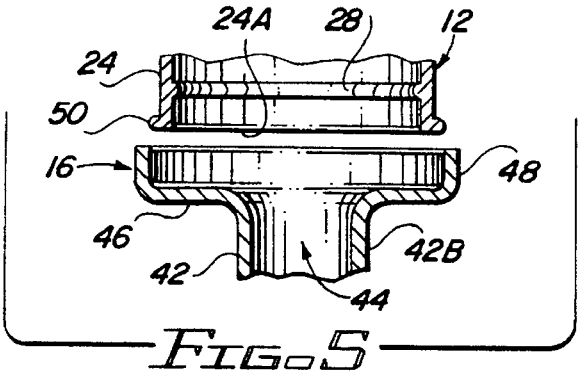
FIG. 5 is an enlarged fragmentary longitudinal sectional view of a lower end portion of the end cap aligned with an upper end portion of the protective cover of the insert assembly, with the insert member and its connection to the end cap being omitted.

Referring to FIGS. 1 and 5, the protective cover 16 in the form of the sleeve includes an elongated tube 42 which is closed at its lower end 42A and open at its opposite upper end 42B. The tube 42 defines a cavity 44 extending between the opposite ends 42A, 42B for receiving the insert member 14 therein. The cover 16 also includes an annular flange 46 formed about and protruding radially outwardly from the upper open end 42B of the tube 42. The cavity 44 is long enough so that the insert member 14 can be pushed into the cavity 44 until the flange 46 makes contact with the end cap 12. In particular, as best seen in FIG. 5, the flange 46 of the cover 16 has an upper annular rim 48 defined about the periphery of the flange 46 which is adapted to interfit over an annular lip or bead 50 attached on the exterior of and protruding radially outward from the lower edge 24A of the outer annular sidewall 24 of the end cap 12. Thus, the exterior annular bead 50 on the outer annular sidewall 24 of the end cap 12 adapted to frictionally interfit within the upper annular rim 48 on the flange 46 of the protective cover 16.

When not in use, the insert assembly 10 is stored in a freezer so that the water 18 in the insert member 14 is frozen. To use the insert assembly 10, it is taken out of the freezer and the protective cover 16 is detached from the end cap 12 and thus removed from the insert member 14. As shown in FIG. 3, the end cap 12 is then applied and secured by the first screw threads 28 thereon over the screw threads S about the top T of the bottle B which contains the quantity of liquid L, such as formula or some other liquid, that needs to be cooled. The insert member 14 extends down into the liquid L so that heat therefrom can be transferred to the frozen water 18 in the insert member 14. After the liquid L is cooled, the end cap 12 is unscrewed from the bottle B, the insert member 14 is rinsed to remove any residual liquid L therefrom, and the protective cover 16 is placed over the insert member 14 and snapped fitted over the lower bead 50 of the outer annular sidewall 24 of the end cap 12. The insert assembly 10 is then placed back in the freezer where it is readied for another use. Because the insert assembly 10 is easily secured and removed from the bottle B, an additional insert assembly 10 can be taken out of the freezer and secured to the bottle B if it is necessary to further cool the liquid L therein.

Figure 6:
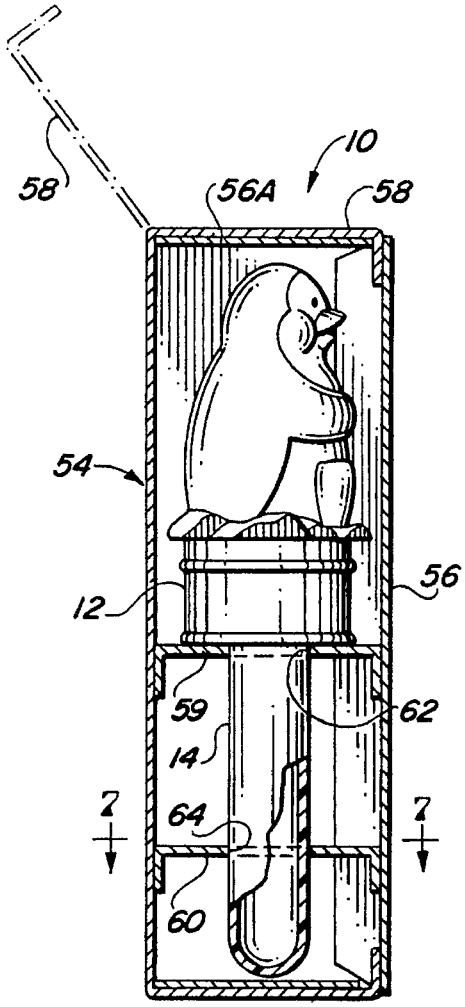
FIG. 6 is a longitudinal sectional view of a second embodiment of an insert assembly of the present invention having a decorative end cap, a reusable insert member connectable to the end cap, and a protective cover in the form of a carton for removably enclosing the decorative end cap and reusable insert member when the insert member is not in use.
Figure 7:
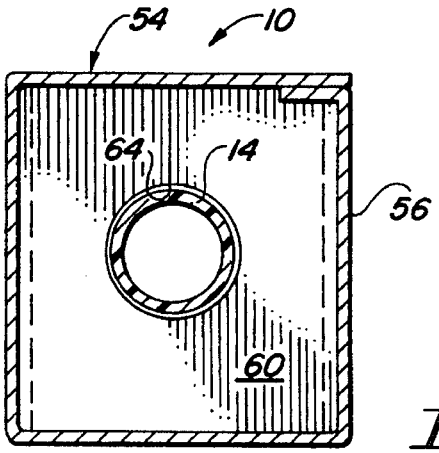
FIG. 7 is an enlarged cross-sectional view of the insert assembly taken along line 7—7 of FIG. 6.

Referring to FIGS. 6 and 7, there is illustrated a second embodiment of an insert assembly of the present invention, generally designated 10. The end cap 12, hollow insert member 14 and ornamental body 20 of the second embodiment of the insert assembly 10 are substantially the same as in the first embodiment. However, instead of a sleeve as in the first embodiment, now in the second embodiment the protective cover 16 includes a carton 54 having a body 56 open at one end 56A and a lid 58 for opening and closing the open end 56A of the carton body 56. The protective cover 16 also includes means in the form of a pair of web members 58, 60 spaced from one another and attached to and extending between a pair of opposite sides 54A of the carton 54 and having respective central apertures 62, 64 defined therein for receiving the hollow insert member 14 therethrough and thereby supporting the insert member 14 and end cap 12 within the carton 54.

When not in use, the end cap 12, insert member 14 and decorative member 20 which are attached together are enclosed in the carton 54 and stored in a freezer so that the water 18 in the insert member 14 will freeze and stay frozen. To use the insert assembly 10, it is taken out of the freezer and the end cap 12, insert member 14 and decorative member 10 are removed from the carton 54. As shown in FIG. 3, the end cap 12 is then applied and secured by the first screw threads 28 thereon over the screw threads S about the top T of the bottle B which contains the quantity of liquid L, such as formula or some other liquid, that needs to be cooled. The insert member 14 extends down into the liquid L so that heat therefrom can be transferred to the frozen water 18 in the insert member 14. After the liquid L is cooled, the end cap 12 is unscrewed from the bottle B, the insert member 14 is rinsed to remove any residual liquid L therefrom, and they are then placed back into the carton 54. The insert assembly 10 is then placed back in the freezer where it is readied for another use.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An insert assembly for use in changing the temperature of a quantity of liquid contained in a bottle, said insert assembly comprising:

(a) an end cap removably securable on a top of a bottle;

(b) an elongated insert member connected to and supported by said end cap and extending therefrom so as to extend into a quantity of liquid in the bottle upon securing said end cap on the top of the bottle; and (c) an elongated protective cover removably enclosing at least said insert member when said insert member is removed from the quantity of liquid in the bottle.

2. The insert assembly of claim 1 wherein said insert member includes:

a tubular body defining a compartment adapted to hold a material therein being provided at a temperature different from that of the quantity of liquid in the bottle; and fastening means defined on an upper end portion of said tubular body.

3. The insert assembly of claim 2 wherein said outer annular wall of said end cap has an exterior annular bead thereon adapted to interfit within an upper annular rim of said protective cover.

4. The insert assembly of claim 2 wherein said end cap includes:

a top wall;

an outer annular sidewall attached to and extending downwardly from said top wall;

an inner annular socket wall attached to and extending downwardly from said top wall and spaced inwardly from said outer annular side wall;

first means defined on an interior side of said outer annular sidewall for releasably mating with securing means defined on an exterior side of the top of the bottle to removably secure said end cap on the top of the bottle; and second means defined on said inner annular socket wall for releasably mating with said fastening means defined on said upper end portion of said insert member to removably connect said insert member to said end cap.

5. The insert assembly of claim 4 wherein said protective cover includes an elongated sleeve removably fittable over said insert member and onto said end cap when said end cap is removed from the bottle such that said sleeve together with said end cap encloses said insert member.

6. The insert assembly of claim 5 wherein said sleeve includes:

an elongated tube closed at a lower end and open at an upper end;

a flange attached to said upper end of said tube and protruding radially outwardly therefrom; and an upper annular rim attached about a periphery of said flange and extending upwardly therefrom, said upper annular rim being adapted to interfit with a lower edge of said outer annular sidewall of said end cap.

7. The insert assembly of claim 1 further comprising:

an ornamental body connected to and seated upon said end cap.

8. The insert assembly of claim 7 wherein:

said end cap has a top wall and an upper annular wall attached to and extending upwardly from said top wall; and said ornamental body has a lower outer annular element adapted to interfit with said upper annular wall of said end cap.

9. The insert assembly of claim 1 wherein said protective cover includes a carton having a body open at one end and a lid for opening and closing the open end of the carton body.

10. The insert assembly of claim 9 wherein said protective cover also includes means in the form of a pair of web members spaced from one another and attached to and extending between a pair of opposite sides of the carton and having apertures defined therein for receiving the insert member and thereby supporting the insert member within the carton.

11. An insert assembly for use in cooling the temperature of a quantity of liquid contained in a bottle, said insert assembly comprising:

(a) an end cap securable to a top of the bottle;

(b) an elongated hollow insert member filled with a quantity of freezable material, said insert attached to and extending downwardly from said end cap into the bottle and into the quantity liquid therein for cooling the quantity of liquid when said end cap is secured to the bottle;

(c) means defined on said end cap for securing said end cap to the top of the bottle, said securing means being adapted to allow said end cap and insert member therewith to be removed from the bottle and placed in a freezer for freezing said quantity of liquid within said insert member and then re-secured on the bottle at a later time; and (d) an elongate protective cover adapted to removably fit over said hollow insert member and releasably attach to said end cap only when said end cap and insert member are removed from the bottle, said cover and end cap together enclosing said insert member so as to to maintain said insert member in a sanitary state when said end cap and insert member are not secured on the bottle.

12. The insert assembly of claim 11 wherein said securing means comprises a plurality of screw threads formed on an inner surface of an outer annular sidewall of said end cap, said threads being adapted to interfit with a plurality of threads formed on an exterior side of the top of the bottle.

13. The insert assembly of claim 12 wherein said insert member includes:

a tubular body defining a compartment adapted to hold a material therein being provided at a temperature different from that of the quantity of liquid in the bottle; and fastening means defined on an upper end portion of said tubular body.

14. The insert assembly of claim 13 wherein said end cap includes:

a top wall;

an outer annular sidewall attached to and extending downwardly from said top wall;

an inner annular socket wall attached to and extending downwardly from said top wall and spaced inwardly from said outer annular side wall;

first means defined on an interior side of said outer annular sidewall for releasably mating with securing means defined on an exterior side of the top of the bottle to removably secure said end cap on the top of the bottle; and second means defined on said inner annular socket wall for releasably mating with said fastening means defined on said upper end portion of said insert member to removably connect said insert member to said end cap.

15. The insert assembly of claim 14 wherein said protective cover includes:

an elongated tube closed at a lower end and open at an upper end;

a flange attached to said upper end of said tube and protruding radially outwardly therefrom; and an upper annular rim attached about a periphery of said flange and extending upwardly therefrom, said upper annular rim being adapted to interfit with a lower edge of said outer annular sidewall of said end cap.

16. The insert assembly of claim 15 wherein said outer annular wall of said end cap has an exterior annular bead thereon adapted to interfit within said upper annular rim of said protective cover.

17. The insert assembly of claim 12 further comprising:

an ornamental body connected to and seated upon said end cap.

18. The insert assembly of claim 17 wherein:

said end cap has a top wall and an upper annular wall attached to and extending upwardly from said top wall; and said ornamental body has a lower outer annular element adapted to interfit with said upper annular wall of said end cap.

19. A method of cooling a quantity of liquid contained within a bottle, said method comprising the steps of:

(a) providing an end cap which may be removeably secured on a bottle containing a liquid to be cooled;

(b) providing an elongated hollow insert member connected to the end cap so as to extend downward from said end cap and is filled with a quantity of freezable liquid;

(c) providing a protective cover fittable over said insert member and releasably securable to said end cap such that together said cover and end cap enclose said insert member to protect said insert member from damage and maintain said insert member in a sanitary state, said connected cover, insert member and end cap thereby providing an insert assembly;

(d) placing said insert assembly in a freezer at least until said quantity of liquid within said insert member is substantially frozen;

(e) removing said insert assembly from the freezer;

(f) removing said cover from said insert member and end cap; and (g) securing said end cap on the bottle so that said insert member extends downward into the bottle and into the quantity of liquid contained within the bottle thereby allowing for the transfer of heat from the quantity of liquid in the bottle to said quantity of frozen liquid within said insert member.

20. A method of cooling an insert assembly and maintaining said insert assembly in a sanitary state ready for use in cooling a quantity of liquid contained within a bottle, said cooling method comprising the steps of:

(a) providing an end cap which may be removeably secured on a bottle containing a liquid to be cooled;

(b) providing an elongated hollow insert member connected to the end cap so as to extend downward from said end cap and is filled with a quantity of freezable liquid;

(c) providing a protective cover for enclosing said insert member and end cap so as to protect said insert member from damage and maintain said insert member in a sanitary state, said protective cover and said insert member and end cap enclosed therein thereby providing an insert assembly; and (d) placing said insert assembly in a freezer at least until said quantity of liquid within said insert member is substantially frozen.

21. The method of claim 20 further comprising the steps of:

(e) removing said insert assembly from the freezer;

(f) removing said cover from said insert member and end cap in preparation for securing said end cap on the bottle so that said insert member will extend downward into the bottle and into the quantity of liquid contained within the bottle to cool the quantity of liquid.

* * * * *